US010920427B2

(12) United States Patent
Girnghuber et al.

(10) Patent No.: US 10,920,427 B2
(45) Date of Patent: Feb. 16, 2021

(54) FAÇADE STRUCTURE

(71) Applicant: Moeding Keramikfassaden GmbH, Marklkofen (DE)

(72) Inventors: Claus Girnghuber, Marklkofen (DE); Rudolf Wagner, Straubing (DE); Dietmar Müller, Frontenhausen (DE)

(73) Assignee: MOEDING KERAMIKFASSADEN GMBH, Marklkofen (DE)

( * ) Notice: Subject to any disclaimer, the term of this patent is extended or adjusted under 35 U.S.C. 154(b) by 0 days.

(21) Appl. No.: 16/567,726

(22) Filed: Sep. 11, 2019

(65) Prior Publication Data

US 2020/0080318 A1 Mar. 12, 2020

(30) Foreign Application Priority Data

Sep. 12, 2018 (EP) ..... 18194051

(51) Int. Cl.
*E04F 13/08* (2006.01)
*E04F 13/14* (2006.01)

(52) U.S. Cl.
CPC ..... *E04F 13/0826* (2013.01); *E04F 13/0812* (2013.01); *E04F 13/142* (2013.01); *E04F 2203/04* (2013.01)

(58) Field of Classification Search
CPC . E04F 13/0826; E04F 13/142; E04F 13/0812; E04F 2203/04
See application file for complete search history.

(56) References Cited

U.S. PATENT DOCUMENTS 4,783,941 A * 11/1988 Loper ..... E04C 2/384 52/235
5,313,760 A * 5/1994 Tojo ..... E04F 13/0825 52/513

(Continued)

FOREIGN PATENT DOCUMENTS

DE 8621835 1/1987
DE 8621835.2 1/1987

(Continued)

OTHER PUBLICATIONS

European Search Report dated Feb. 18, 2019.

*Primary Examiner* — Adriana Figueroa
(74) *Attorney, Agent, or Firm* — Hoffmann & Baron, LLP

(57) ABSTRACT

A façade structure is described, with a substructure formed of support profiles, which is arranged in front of a building wall and anchored fixedly in the floor and/or in the building wall, with extruded façade tiles made of ceramic material, which are fastened to the substructure via tile holders, wherein the tile holders are arranged on all or only some of the support profiles, the tile holders being fastened to the support profiles directly or via separate supports, and the tile holders having receivers, which engage with edge areas of the façade tiles to fasten the façade tiles. In order to obtain a shake-proof arrangement of the façade tiles, it is provided that press-on elements are arranged concealed behind the façade tiles supported on the substructure; and that the press-on elements are in each case assigned to only one façade tile in such a way that the press-on elements in each case grip on the back of the assigned façade tile in an area which is arranged at a distance from the tile holders gripping with their receivers on the façade tile, and the assigned façade tile is resiliently impinged on in the direction towards the front like a shake-proof receiver of the façade tile.

14 Claims, 7 Drawing Sheets

(56) References Cited

U.S. PATENT DOCUMENTS

| | | | | | |
|---|---|---|---|---|---|
| 5,417,020 | A * | 5/1995 | Dobija | ..... | E04F 13/0826<br>52/235 |
| 7,726,083 | B2 | 6/2010 | Wagner | | |
| 8,567,140 | B2 | 10/2013 | Wagner | | |
| 9,382,715 | B2 * | 7/2016 | Cottier | ..... | E04F 13/09 |

FOREIGN PATENT DOCUMENTS

| | | | | | |
|---|---|---|---|---|---|
| DE | 3934686 | A1 | 6/1990 | | |
| DE | 3934686 | A1 | 6/1990 | | |
| DE | 9319695 | U1 * | 2/1994 | ..... | E04F 13/0812 |
| DE | 19751820 | A1 * | 6/1998 | ..... | E04F 13/0812 |
| DE | 10205623 | A1 | 9/2003 | | |
| DE | 10205623 | A1 | 9/2003 | | |
| DE | 102007037566 | A1 | 2/2009 | | |
| DE | 102007037566 | A1 | 2/2009 | | |
| EP | 1878847 | A2 | 1/2008 | | |
| EP | 1878847 | A2 | 1/2008 | | |
| EP | 1923523 | A2 * | 5/2008 | ..... | E04F 13/10 |
| EP | 2186966 | A2 | 5/2010 | | |
| JP | 2002294975 | A * | 10/2002 | | |
| JP | 2002294975 | A | 10/2002 | | |
| JP | 2002294975 | | 10/2009 | | |

* cited by examiner

1
F
11
12
12
12
12
12
13h
13
13f
28
19
13
19
28
13f
13
13h
19
13
28
13
42b
421
42
4
421
121
SPR

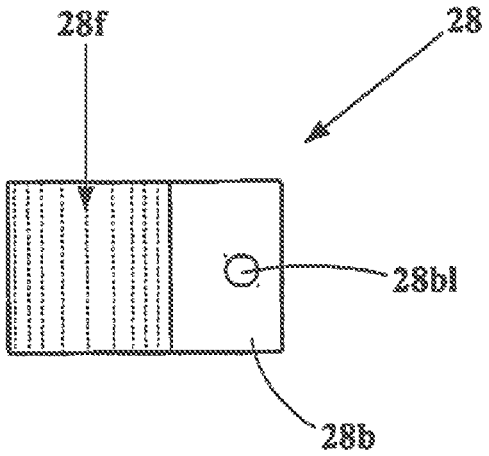
Fig. 3
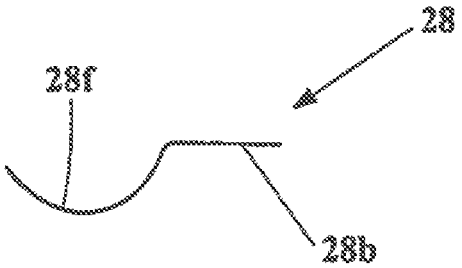

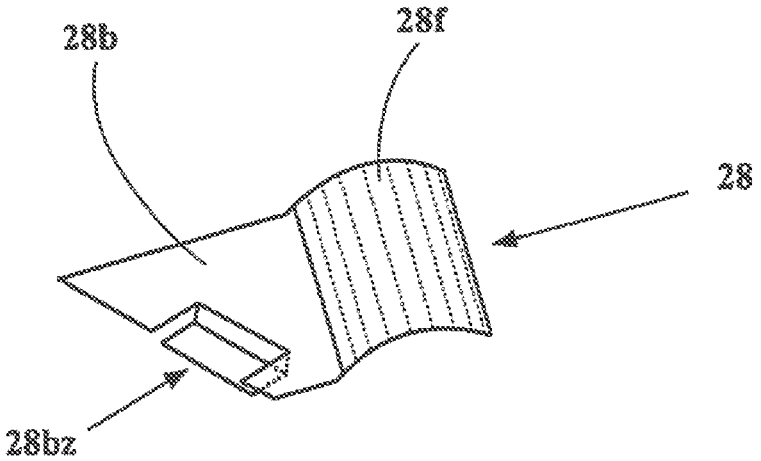
Fig. 4
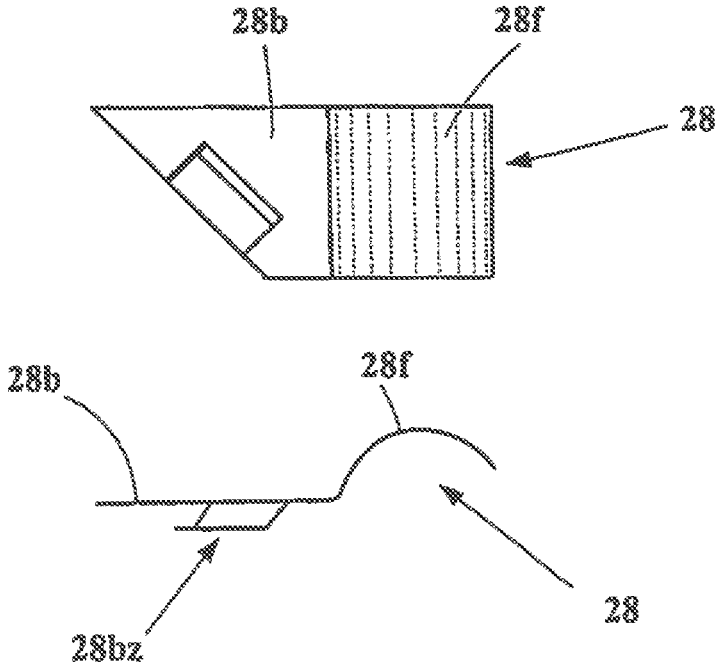

FAÇADE STRUCTURE

BACKGROUND OF THE INVENTION

The invention is based on a façade structure, preferably a curtain-wall back-ventilated façade structure. The façade structure has a substructure formed of support profiles. The substructure is arranged in front of a building wall and anchored fixedly in the floor and/or in the building wall. The façade structure has extruded façade tiles made of ceramic material, preferably clay material. The façade tiles are fastened to the substructure via tile holders. The tile holders are arranged on all or only some of the support profiles of the substructure. The tile holders are fastened to the support profiles directly or via separate supports. The tile holders have receivers which engage with edge areas of the façade tiles to fasten, i.e. hold, the façade tiles.

Such façade structures are described in EP 1 878 847 A2, EP 2 186 966 A2 and DE 10 2007 037 566 A1. In these structures, in each case the façade tiles are arranged in the horizontal format, i.e. with their extrusion direction running horizontally. In each case the tile holders have H-shaped receivers, i.e. double receivers, consisting of a U-shaped receiver open towards the bottom and a U-shaped receiver open towards the top. In the façade structure, the U-shaped receivers engage with the lower and upper edges of the façade tiles.

In order to obtain a shake-proof arrangement of the façade tiles, in practice vertical joint profiles are inserted into the vertical joints between horizontally adjacent façade tiles. The known joint profiles are as a rule components made of spring steel sheet with a substantially a-shaped cross section with angled base arms. They are arranged in the vertical joint profile between the front of the support profile and the back of the façade tiles, in order to obtain a shake-proof arrangement of the façade tiles by their gripping behind the vertical edges of the adjacent façade tiles in the joint area. Such joint profiles are shown in EP 1 878 847 A2. Instead of such joint profiles it is also possible to arrange spring elements directly in the U-shaped receivers of the tile holders. Such spring elements as elastic clips in the U-shaped receivers of the tile holders are described in EP 1 878 847 A2.

SUMMARY OF THE INVENTION

The object of the invention is to develop a façade structure which makes possible a shake-proof arrangement of the façade tiles in a manner which is simple in terms of construction and cost-effective.

The invention achieves this object with the subject-matter of main claim 1.

Main claim 1 provides a façade structure, preferably formed as a curtain-wall back-ventilated façade structure. The façade structure has a substructure formed of support profiles. This can be a plurality of identical support profiles, but also different support profiles, with which the substructure is produced, namely in such a way that the substructure is arranged in front of a building wall and anchored fixedly in the floor and/or in the building wall.

The façade tiles are façade tiles formed with ridges and/or extruded. The façade tiles are preferably formed from ceramic material, e.g. clay material. The façade tiles are fastened to the substructure via tile holders. The façade tiles preferably have ridges.

The ridges preferably extend along opposite outside rims of the façade tiles. The longitudinal extent of the ridges therefore corresponds to the longitudinal extent of these rims. The ridges preferably form the edge areas of these rims.

All or only some of the support profiles which form the substructure have tile holders. The tile holders are fastened, preferably detachably, to the support profiles directly or via separate supports. The tile holders have receivers which engage with edge areas of the façade tiles to fasten the façade tiles.

An essential solution feature is that press-on elements are provided next to the tile holders. These are press-on elements which are arranged concealed behind the façade tiles on the substructure, preferably fastened detachably. The press-on elements are in each case assigned to only one façade tile, namely in such a way that the press-on elements in each case grip on the back of the assigned façade tile in an area which is arranged at a distance from the tile holders gripping with their receivers on the façade tile. The assigned façade tile is resiliently impinged on by the press-on element in the direction towards the front, like a shake-proof receiver of the façade tile. It can be provided that only one such press-on element is assigned to each façade tile. However, embodiments are also possible in which several such press-on elements are assigned to a façade tile and thus the several press-on elements resiliently impinge on the respective façade tile in the direction towards the front, like a shake-proof receiver of the façade tile. The shake-proof receiver of the façade tile in particular results from the fact that the façade tile in the preferably U-shaped receivers of the plate holders is resiliently impinged on into a construction with the front arm of the U-shaped receiver.

Embodiments of the press-on element that are advantageous in terms of construction and manufacturing technology, with high functional reliability, are possible in particular if it is provided that the press-on element has a compression spring device. It can e.g. be provided that the compression spring device has a press-on spring clip for cooperating with the back of the assigned façade tile. The press-on spring clip cooperates, with the outside of the spring clip, with the back of the façade tile. The press-on spring clip can have a fluting on the outside in particular embodiments.

With regard to the fastening of the press-on elements, it can advantageously be provided that the press-on element has a fastening section, via which the press-on element is fastened to a support profile of the substructure, preferably to a support profile to which one or more of the tile holders is or are fastened. It can be provided for this purpose that the fastening section is fastened to the support profile by means of a screw connection and/or a rivet connection and/or a clamping connection and/or a plug-in device engaging in a positive-locking manner in a slot in the support profile.

The façade tiles can be used in vertical format or in horizontal format, forming a vertical façade tile structure or a horizontal façade structure respectively.

With regard to the horizontal-format use of the façade tiles, it can preferably be provided that the façade tiles are formed with ridges and/or extruded, and that the façade structure is formed as a horizontal façade structure, in which the façade tiles are aligned with the longitudinal extent of their ridges and/or extrusion direction horizontal, and that the tile holders grip on the upper and lower horizontal edges of the façade tiles with their preferably U-shaped receiver.

With regard to the vertical-format use of the façade tiles, it can preferably be provided that the façade tiles are formed with ridges and/or extruded, and that the façade structure is formed as a vertical façade structure, in which the façade tiles are aligned with the longitudinal extent of their ridges and/or extrusion direction vertical, and that the tile holders grip on opposite vertical edges of the façade tiles with their preferably U-shaped receiver, and that in each case at least one weight-supporting holder grips on the façade tiles, preferably on the lower horizontal edge of the façade tile, with a preferably L-shaped receiver, wherein the weight-supporting holder is fastened, preferably detachably, to one of the support profiles, to which the tile holders are fastened directly or via separate supports, or to a further support profile of the substructure.

The gripping of the U-shaped and L-shaped receivers on the edge of the façade tile can be formed as a gripping around on several sides with support, or also only as a support on one side.

BRIEF DESCRIPTION OF THE DRAWINGS

The invention is now explained in more detail with reference to figures.

There are shown in:

FIG. 3 a press-on element from the façade structure of FIG. 2 in a detail representation;

FIG. 4 a press-on element modified compared with FIG. 3;

DETAILED DESCRIPTION

Figure 1:
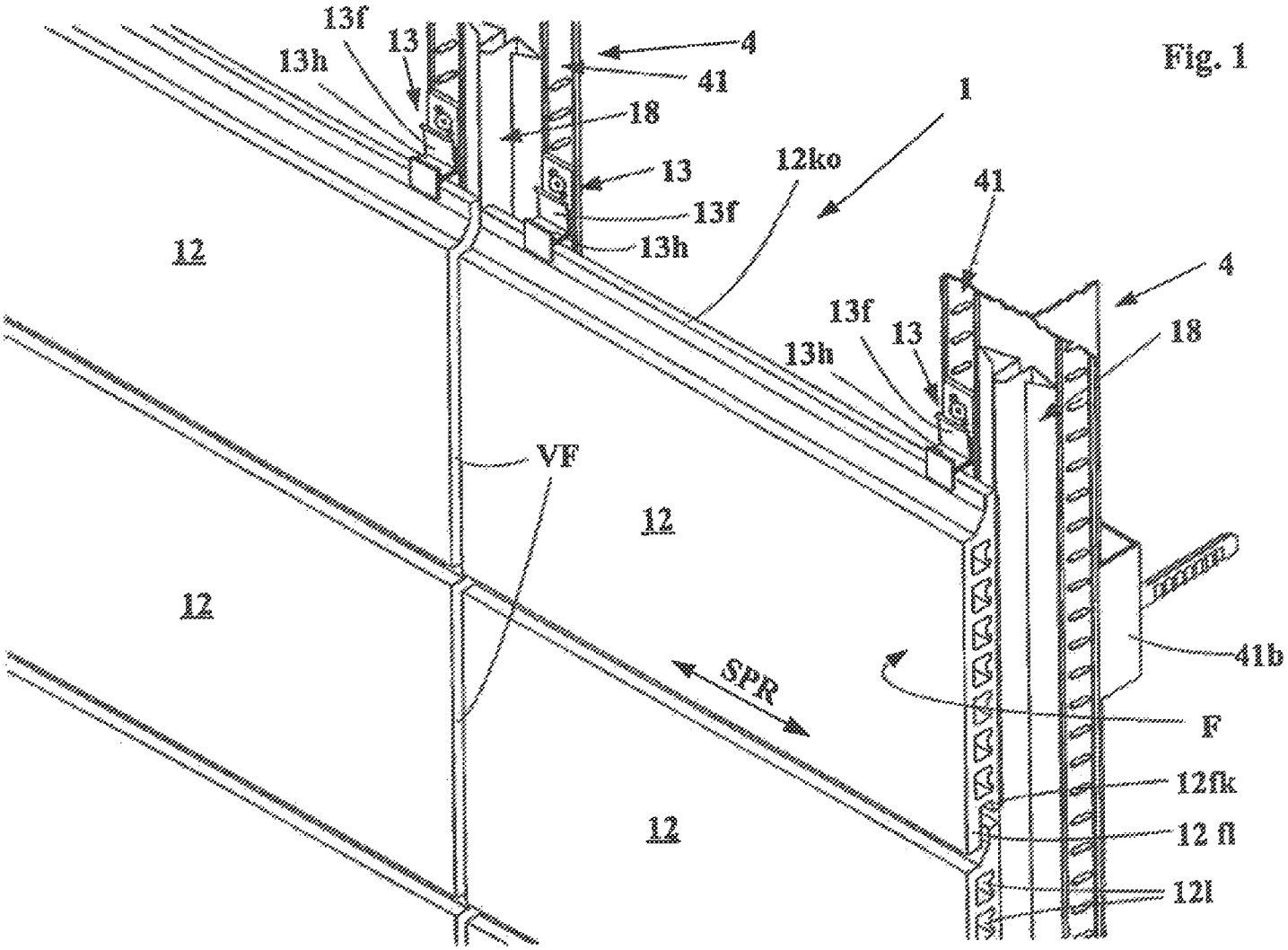
FIG. 1 a first façade structure as a horizontal façade structure in a perspective view.
Figure 1A:
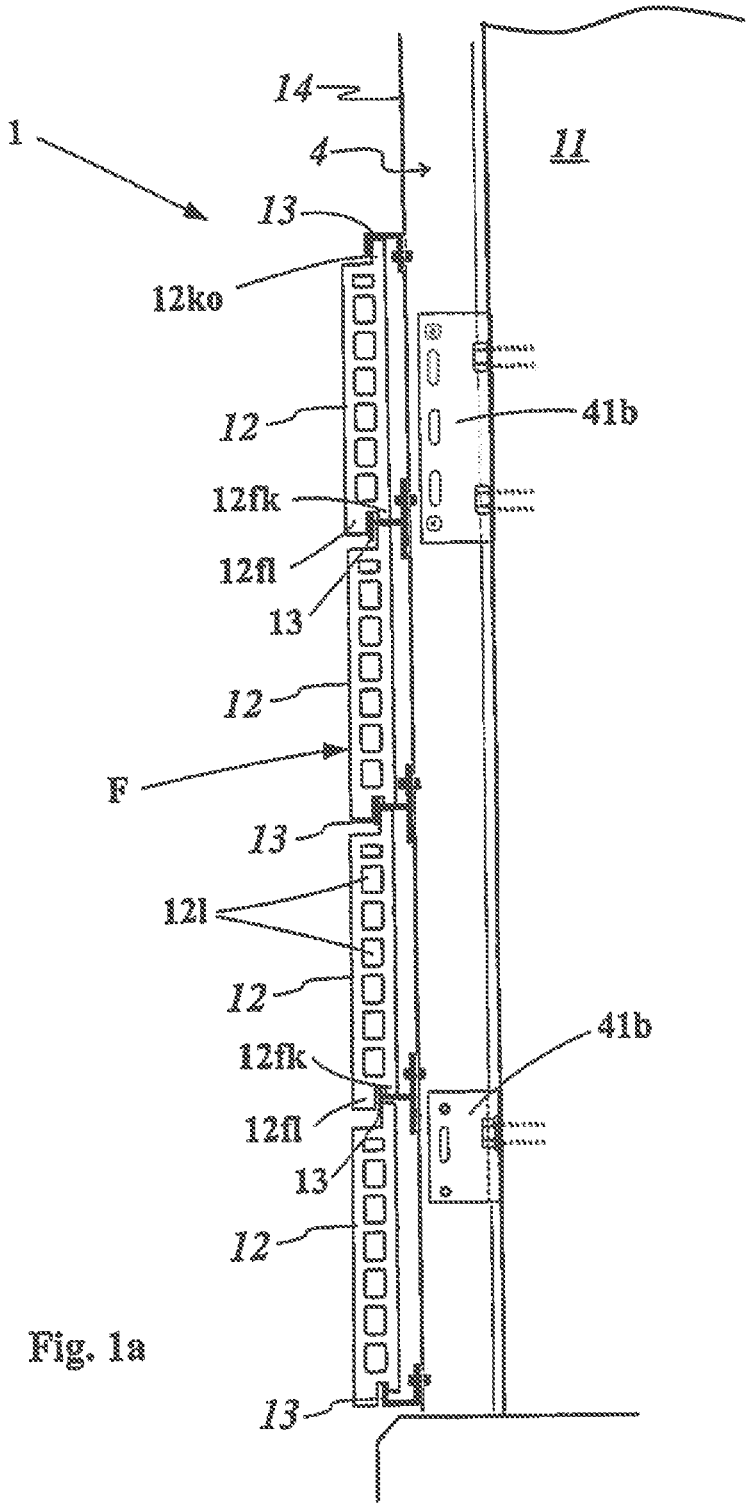
FIG. 1*a* the façade structure of FIG. 1 in a schematic side view.
Figure 2:
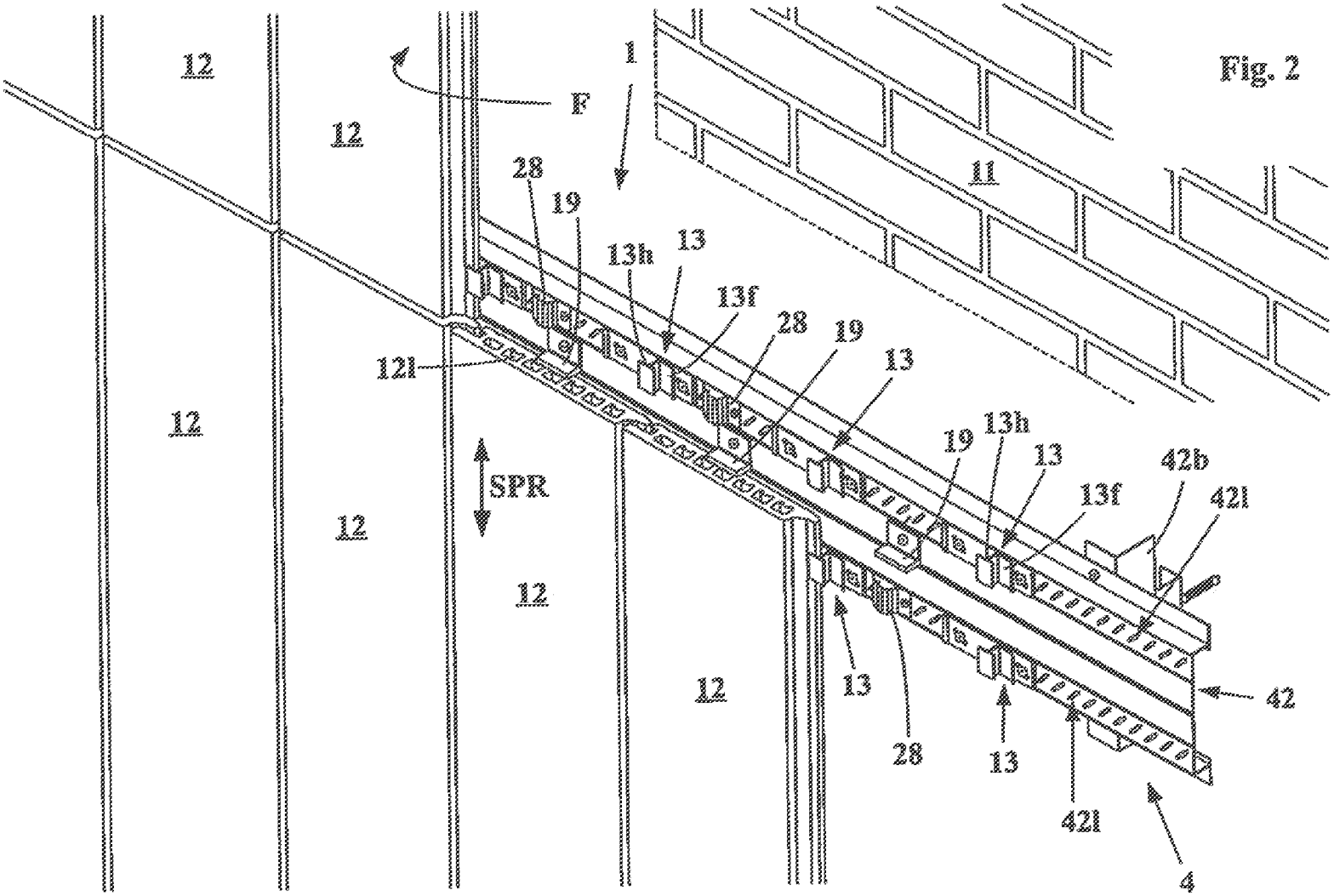
FIG. 2 a second façade structure as a vertical façade structure in a perspective view.

FIG. 1 shows a first embodiment of a façade structure 1 and FIG. 2 shows a second embodiment of a façade structure 1. Correspondingly, they are in each case a façade structure with façade tiles 12, which are arranged on a substructure 4 in front of a building wall 11. The façade tiles 12 are in each case extruded tiles made of ceramic material which are rectangular in outline. The tiles are rectangular in outline and have parallel elongated holes 121 running in the extrusion direction SPR. The elongated holes 121 are arranged evenly distributed over the outline face of the tile in the longitudinal centre plane of the tiles at an identical mutual distance. The façade tiles 12 are arranged in the façade structure of FIGS. 1 and 2 in each case such that their fronts are aligned with each other in each case, forming a common front plane F.

Regarding now the differences between the two embodiments in FIGS. 1 and 2:

In the first embodiment of the façade structure 1 represented in FIG. 1 the façade tiles 12 are arranged in the horizontal format, i.e. the façade tiles 12 are arranged in the façade structure such that their extrusion direction SPR is arranged horizontally. In contrast, in the second embodiment of the façade structure represented in FIG. 2 the façade tiles 12 are arranged in vertical format, i.e. the façade tiles 12 are arranged in this façade structure such that their extrusion direction SPR is arranged vertically. The façade tiles 12 are designed identically in both embodiments of the façade structure. They are simply in horizontal format in FIG. 1 and in vertical format in FIG. 2, i.e. arranged rotated by 90° about their vertical axis.

In the case of the first façade structure in FIG. 1 the substructure 4 is formed by vertical support profiles 41. Tile holders 13 are fastened to the support profiles 41 in vertical rows. The tile holders 13 in each case have an H-shaped receiver 13*h*. Façade tiles 12 arranged in each case in a vertical line engage in the H-shaped receivers 13*h* with their back ridge edges facing the receiver. The back ridge edges are offset relative to the forward front of the façade tile backwards in the direction of the building wall 11. The façade tiles 12 in FIG. 1 have a single head ridge 12*ko* in each case on their upper edge; this is formed in the back plane. On their lower edge the façade tiles have in each case a longer base ridge 12*fl* in a front plane and a shorter base ridge 12*fk* in the back plane. The head ridge 12*ko* of the lower façade tile 12 engages in the lower receiver of the H-shaped receiver 13*h*. The back short base ridge 12*fk* of the upper façade tile 12 engages in the upper receiver, wherein the longer base ridge 12*fl* covers the H-shaped receiver 13*h* on the front.

The façade tiles 12 are thus held in the façade structure in FIG. 1 via the tile holders 13 in that tile holders 13 grip in each case on the upper edge and on the lower edge with their H-shaped receivers 13*h*, namely on the upper edge of the façade tile with the lower receiver of the H-shaped receiver and on the lower edge of the façade tile with the upper receiver of the H-shaped receiver.

As can be seen in FIG. 1, vertical joints VF are formed between horizontally adjacent façade tiles. Joint profiles 18 engage in these joints. The joint profiles 18 are formed as spring steel sheet profiles with a substantially a-shaped cross section with angled base arms. The joint profile 18 is arranged between the front of the support profile 41 and the back of the façade tiles horizontally adjacent to each other via the joint. The joint profile 18 extends along the longitudinal centre axis of the support profile 41 over several horizontal rows of the façade tiles. The joint profile 18 impinges on the façade tiles such that they are pushed into the receivers 13*h* of the tile holders 13 in the direction towards the front of the façade structure and come to bear against the inside of the front arm of the U-shaped receivers of the tile holders 13. The joint profile 18 thus ensures a shake-proof arrangement of the façade tiles in the tile holders 13.

In the case of the tile holders 13 used in the embodiment in FIG. 1, clip-shaped stainless steel springs 13*f* made of sheet steel, which engage in assigned rearward grooves in the façade tiles and thus prevent the façade tiles from lifting off, are integrated in the receivers of the tile holders. Such stainless steel springs 13*f* in receivers of tile holders are described e.g. in EP 1 878 847 A2.

In the case of the second embodiment of the façade structure represented in FIG. 2—as stated this is a vertical façade structure—the substructure 4 is formed by horizontal support profiles 42. Tile holders 13 are fastened to the support profiles 42 in horizontal rows. The tile holders 13 are constructed identically to the tile holders in FIG. 1. They have H-shaped receivers 13*h* with clip-shaped stainless steel springs 13*f* integrated therein. In particular in the case of this use of the tile holders 13 in the vertical façade structure, in particular embodiments clip-shaped stainless steel springs 13*f* can be arranged in the H-shaped receivers in both receivers in order to hold the engaging ridge edge. The tile holders 13 grip with their H-shaped receivers on the vertical side edges of the façade tiles 12 arranged in vertical format. In each case the back ridge edges of the façade tiles engage in the receivers of the tile holders 13. The engagement of the lateral ridge edges in FIG. 2 in the H-shaped receivers of the tile holders 13 is effected in a manner corresponding to the engagement of the upper and lower ridge edges in the case of the horizontal façade structure in FIG. 1. The horizontal support profiles 42 in FIG. 2 are preferably identical components to those in the case of the vertical support profiles 41 of FIG. 1, wherein those in FIG. 2 are simply arranged in a horizontal arrangement, i.e. rotated 90° about the vertical axis. The tile holders 13 in FIG. 2 are preferably also tile holders which are formed identically and are arranged on the support profiles 42 identically to the tile holders 13 in FIG. 1. However, the tile holders 13 in the façade structure in FIG. 2 differ from the tile holders 13 in the façade structure in FIG. 1 with respect to the function. In FIG. 2 the tile holders 13 simply bear the wind loads, as they simply grip laterally with their receivers on the vertical edges of the façade tiles.

In the vertical façade structure in FIG. 2 separate angled brackets 19 with an angular L-shaped receiver are attached to the support profiles 42 to support the weight loads. The fastening of the angled brackets 19 to the support profiles 42 is effected, as shown in FIG. 2, via a screw or rivet connection on the front of the support profile 42 outside the fastening rows of elongated holes, in which the angled brackets 19 are fastened via a rivet connection. The façade tiles 12 bear with their lower edges on the angled brackets 19. For this, the free arm of the angular L-shaped receiver of the angled brackets 19 grips underneath the lower edge of the façade tiles 12, preferably without protruding at the front (see FIG. 5).

As shown in FIG. 5, the angled bracket 19 gripping on the lower edge of the façade tile 12 can be concealed by a ridge which is formed by a lower cut 12*a* on the lower edge of this façade tile, and additionally by a ridge which is formed by an upper cut 12*b* on the upper edge of the façade tile 12 adjoining it at the bottom. The support holder 19 engages between the lower horizontal edge of the upper façade tile and the upper horizontal edge of the façade tile adjoining it at the bottom. At the front, the angled bracket 19 is concealed by the ridge which is formed as a front ridge in each case by the lower cut 12*a* on the lower horizontal edge and by the upper cut 12*b* on the upper horizontal edge of the façade tile.

Figure 5A:
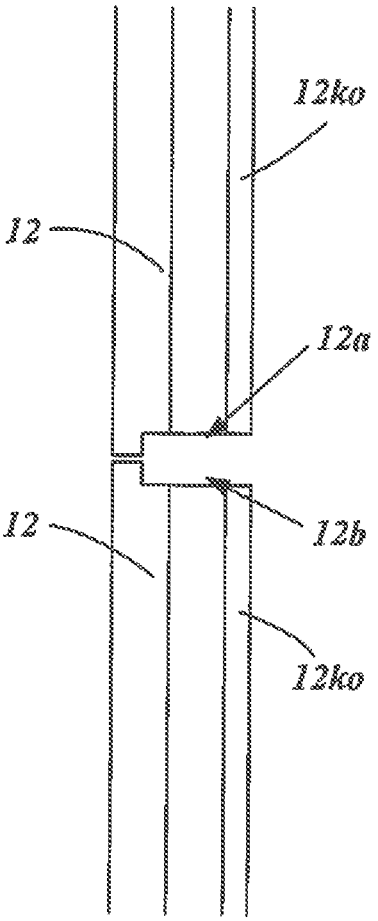
FIG. 5*a* schematic side view of the façade structure as a vertical façade structure from FIG. 2 with cuts into the lower or upper edge of the façade tile for a weight-supporting holder.
Figure 5B:
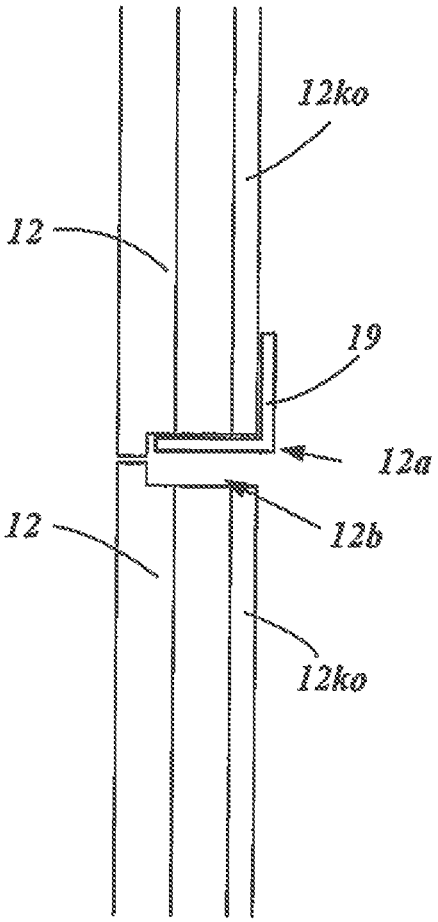
FIG. 5*b* schematic side view of the façade structure as a vertical façade structure from FIG. 2 with a weight-supporting holder in the cuts.
Figure 5C:
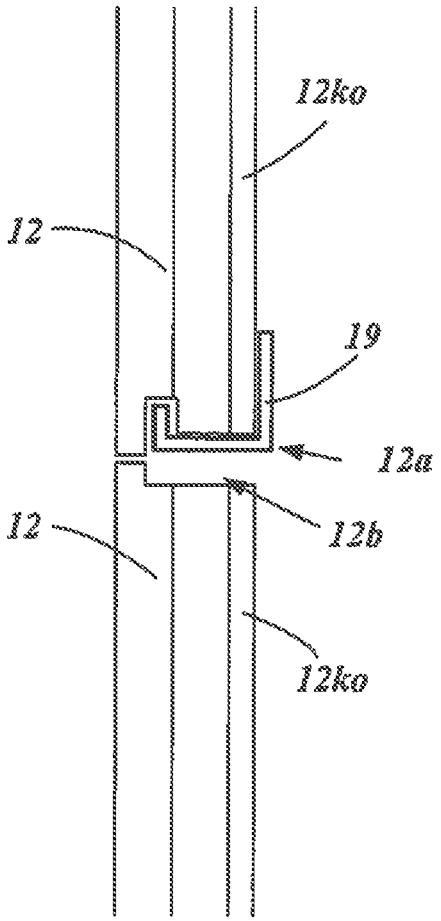
FIG. 5*c* schematic side view of the façade structure as a vertical façade structure from FIG. 2 with a second design of the cuts and U-shaped angled brackets.

As shown in FIG. 5*c*, in embodiments modified compared with FIG. 2, the angled bracket 19 can also be formed bent, i.e. in the broadest sense with a U-shaped cross section, and can engage in a groove cut into the lower edge of the façade tile 12. The lower edge of the façade tiles can be formed in the broadest sense with a front ridge and a back ridge and the angled bracket 19 can grip around the back ridge edge.

Figure 5D:
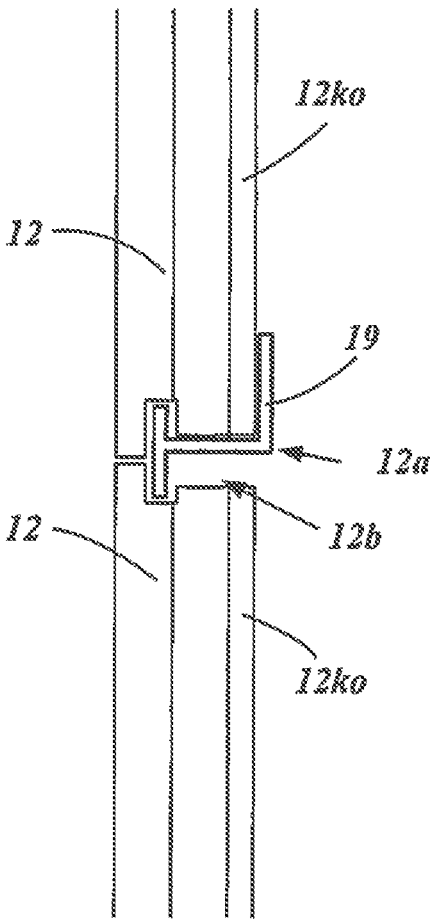
FIG. 5*d* schematic side view of the façade structure as a vertical façade structure from FIG. 2 with a third design of the cuts and H-shaped angled brackets.

In embodiments modified compared with FIG. 2, the upper edge of the façade tiles 12 can also be formed with a comparable groove or with a front ridge and a back ridge (see FIG. 5*d*). The angled bracket 19 can have a bend on its underside and can correspondingly engage in the lower edge of the façade tiles, i.e. can engage in the groove or grip around the back ridge. Alternatively, a separate upper support holder, which is fastened to the support profile 42 separately, can also be provided for the engagement in the upper edge of the façade tiles 12. For this, the support holder can be formed with a substantially L-shaped cross section with a bend on its underside.

For the shake-proof arrangement of the façade tiles 12 in the H-shaped receivers 13*h* of the tile holders 13, press-on elements 28 arranged in each case concealed behind the façade tiles 12 are provided in the vertical façade structure in FIG. 2 instead of the joint profiles 18 used in FIG. 1. The press-on elements 28 cooperate in each case individually with a façade tile 12, i.e. one separate press-on element 28 per façade tile 12. The press-on elements 28 are formed of spring steel sheet. They have a spring clip 28*f* and a fastening section 28*b*. The press-on element 28 is arranged between the front of the support profile 42 and the back of the façade tile 12 and acts on the back of the façade tile 12 with the outside of the spring clip 28*f* and impinges on the façade tile in the direction towards the front of the façade structure. The press-on elements 28 are fastened to the support profile 42 with their fastening section 28*b* in the façade structure represented in FIG. 2, namely via a rivet connection in an elongated hole of the row of elongated holes, in which the tile holders 13 are also fastened.

The fastening of the press-on elements 28 is effected in the elongated holes of the row of elongated holes 42*l*, which is formed in the support profile. The tile holders 13 are also fastened in the same row of elongated holes 42*l*, namely in the same way as the press-on elements 28. In the same way, in the case of the façade structure in FIG. 1 the tile holders 13 are also fastened in the corresponding row of elongated holes 41*l* in the support profile 41. This is a fastening such as is known from EP 2 186 966 A2.

Unlike the press-on element 28 used in FIG. 2, the modified embodiment of the press-on element 28 represented in FIG. 4 has a fastening section, which is formed as a clamping lug. For the fastening, the clamping lug cooperates with the elongated hole of the row of inclined elongated holes 42*l* selected for the respective position in the profile support 42, namely forming a clamping connection. For this, the clamping lug, as represented in the detail representation in FIG. 4, has an inclined end edge, in which a Z-shaped bend is formed. The incline of the end edge corresponds to the angle of inclination of the elongated hole of the row of elongated holes. In the clamping position the Z-shaped bend engages in the elongated hole and is pushed in as far as it will go, with the result that the Z-shaped bend grips behind the section of the support profile behind the elongated hole. The press-on element 28 in the different embodiments of FIGS. 3 and 4 can also be used in the case of the horizontal façade structure represented in FIG. 1, namely fastened to the support profile 41 in a manner corresponding to what was described above for the façade structure of FIG. 2. The press-on element 28 can thus replace the joint profile 18 or be used in addition to the joint profile 18.

LIST OF REFERENCE NUMBERS

1 façade structure
4 substructure
41 support profile (FIG. 1)
41*b* fastening section of 41
41*l* row of elongated holes in 41
42 support profile (FIG. 2)
42*l* row of elongated holes in 42
11 building wall
12 façade tile

12*a* lower cut for a weight-supporting holder/angled bracket
12*b* upper cut for a weight-supporting holder/angled bracket
121 elongated hole
12*ko* head ridge=single back ridge edge at the head
12*fl* base ridge long=front ridge edge at the base
12*fk* base ridge short=back ridge edge at the base
13 tile holder
13*h* H-shaped receiver of the tile holder
13*f* stainless steel spring
18 joint profile
19 angled bracket, weight-supporting holder
28 press-on spring element
28*f* spring clip
28*b* fastening section
28*b*1 fastening hole
28*bz* Z-shaped bend
SPR extrusion direction
F front plane of the façade structure
VF vertical joint

What is claimed is:

1. A façade structure, with a substructure formed of support profiles, which is arranged in front of a building wall and anchored fixedly in the floor and/or in the building wall, with façade tiles with ridges and/or extruded, which are fastened to the substructure via tile holders, wherein the tile holders are arranged on all or only some of the support profiles, the tile holders being fastened to the support profiles directly or via separate supports, and the tile holders having receivers, which engage with edge areas of the façade tiles to fasten the façade tiles, and wherein press-on elements are arranged concealed behind the façade tiles supported against the substructure, and wherein the press-on elements are in each case assigned to only one of the façade tiles, in such a way that the press-on elements in each case grip on the back of the assigned façade tile in an area which is arranged at a distance from the tile holders gripping with their receivers on the façade tile, and the assigned façade tile is resiliently impinged on in the direction towards the front in the sense of a shake-proof reception of the façade tile, and wherein the press-on element has a fastening section via which the press-on element is fastened to a support profile of the substructure, and wherein the fastening section is fastened to the support profile via a plug-in device engaging in a positive-locking manner in a slot of a row of inclined elongated holes in the support profile, the slot being formed as an elongated hole in the row of inclined elongated holes formed in the support profile, and wherein the fastening section is formed as a clamping lug, which, for the fastening, cooperates with the elongated hole of the row of inclined elongated holes selected for the respective position in the profile support forming a clamping connection, wherein the clamping lug has an inclined end edge, in which a Z-shaped bend is formed for engagement in the selected elongated hole, and the incline of the end edge corresponds to the angle of inclination of the elongated hole of the row of elongated holes.

2. The façade structure according to claim 1, wherein the façade structure is a curtain-wall back-ventilated façade structure.

3. The façade structure according to claim 1, wherein the façade tiles are made of ceramic material.

4. The façade structure according to claim 1, wherein the tile holders are detachably fastened to the support profiles.

5. The façade structure according to claim 1, wherein the press-on element has a compression spring device.

6. The façade structure according to claim 5, wherein the compression spring device has a press-on spring clip for cooperating with the back of the assigned façade tile.

7. The façade structure according to claim 1, wherein the press-on element is fastened to the support profile to which one or more of the tile holders is or are fastened.

8. The façade structure according to claim 1, wherein the façade tiles are formed with ridges and/or extruded, and wherein the façade structure is formed as a horizontal façade structure, in which the façade tiles are aligned with the longitudinal extent of their ridges and/or the extrusion in a horizontal direction, and wherein the tile holders grip on the upper and lower horizontal edges of the façade tiles.

9. The façade structure according to claim 1, wherein the tile holders grip with a U-shaped receiver on the upper and lower horizontal edges of the façade tiles.

10. The façade structure according to claim 1, wherein the façade tiles are formed with ridges and/or extruded, and wherein the façade structure is formed as a vertical façade structure, in which the façade tiles are aligned with the longitudinal extent of their ridges and/or extrusion in a vertical direction, and wherein the tile holders grip on opposite vertical edges of the façade tiles, and wherein, in each case, at least one weight-supporting holder grips on the façade tiles, wherein the weight-supporting holder is fastened to one of the support profiles, to which the tile holders are fastened directly or via separate supports, or to a further support profile of the substructure.

11. The façade structure according to claim 10, wherein the tile holders grip with a U-shaped receiver on opposite vertical edges of the façade tiles.

12. The façade structure according to claim 10, wherein the at least one weight-supporting holder grips on the lower horizontal edge of the façade tile.

13. The façade structure according to claim 12, wherein the at least one weight-supporting holder grips on the lower horizontal edge of the façade tile with a L-shaped receiver.

14. The façade structure according to claim 10, wherein the weight-supporting holder is detachably fastened to one of the support profiles, to which the tile holders are fastened directly or via separate supports.

* * * * *